US010294938B2

(12) United States Patent
Imai et al.

(10) Patent No.: US 10,294,938 B2
(45) Date of Patent: May 21, 2019

(54) SCROLL COMPRESSOR WITH MOVABLE NON-ORBITING SCROLL

(71) Applicant: Panasonic Intellectual Property Management Co., Ltd., Osaka-shi, Osaka (JP)

(72) Inventors: Yusuke Imai, Shiga (JP); Sadayuki Yamada, Gunma (JP); Atsushi Sakuda, Shiga (JP); Akihiro Hayashi, Shiga (JP); Takashi Morimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 52 days.

(21) Appl. No.: 15/503,653

(22) PCT Filed: Sep. 10, 2015

(86) PCT No.: PCT/JP2015/004601

§ 371 (c)(1),
(2) Date: Feb. 13, 2017

(87) PCT Pub. No.: WO2016/056172

PCT Pub. Date: Apr. 14, 2016

(65) Prior Publication Data

US 2017/0268511 A1 Sep. 21, 2017

(30) Foreign Application Priority Data

Oct. 7, 2014 (JP) ..... 2014-206518

(51) Int. Cl.
*F03C 2/00* (2006.01)
*F03C 4/00* (2006.01)
(Continued)

(52) U.S. Cl.
CPC ..... *F04C 18/0215* (2013.01); *F04C 23/008* (2013.01); *F04C 27/005* (2013.01);
(Continued)

(58) Field of Classification Search
CPC ..... F04C 18/0215; F04C 18/0246; F04C 18/0253; F04C 18/0269; F04C 23/008; F04C 2240/60; F04C 2240/50
(Continued)

(56) References Cited

U.S. PATENT DOCUMENTS 5,102,316 A 4/1992 Caillat et al.
5,192,202 A 3/1993 Lee
5,741,120 A * 4/1998 Bass ..... F04C 18/0215 418/55.5
(Continued)

FOREIGN PATENT DOCUMENTS

JP 01-227885 9/1989
JP 04-255586 9/1992
(Continued)

OTHER PUBLICATIONS

International Search Report and Written Opinion; International Patent Application PCT/JP2015/004601, dated Dec. 1, 2015 with English translation of Search Report (9 pages).

*Primary Examiner* — Theresa Trieu
(74) *Attorney, Agent, or Firm* — Hamre, Schumann, Mueller & Larson, P.C.

(57) ABSTRACT

An elastic body is provided which biases one of a fixed scroll and an orbiting scroll in a direction in which the fixed scroll and the orbiting scroll are spaced away from each other. With this, upon the start-up of a compressor, a gap is formed between the fixed scroll and the orbiting scroll, and thus the startability is improved.

8 Claims, 14 Drawing Sheets

(51) Int. Cl.

| | |
|---|---|
| ***F04C 18/00*** | (2006.01) |
| ***F04C 2/00*** | (2006.01) |
| ***F04C 18/02*** | (2006.01) |
| ***F04C 23/00*** | (2006.01) |
| ***F04C 27/00*** | (2006.01) |
| ***F04C 29/00*** | (2006.01) |

(52) U.S. Cl.
CPC ..... *F04C 29/0028* (2013.01); *F04C 2240/50* (2013.01); *F04C 2240/60* (2013.01)

(58) Field of Classification Search
USPC ..... 418/55.1–55.6, 57, 94, 102
See application file for complete search history.

(56) References Cited

U.S. PATENT DOCUMENTS

| | | | | |
|---|---|---|---|---|
| 6,027,321 | A * | 2/2000 | Shim | F04C 18/0215 418/55.5 |
| 6,257,852 | B1 * | 7/2001 | Tarng | F04C 18/0215 418/55.5 |
| 2007/0110605 | A1 | 5/2007 | Masuda | |
| 2008/0038134 | A1 | 2/2008 | Masuda | |
| 2015/0152868 | A1 * | 6/2015 | Fu | F04C 18/0215 418/55.5 |
| 2016/0084250 | A1 * | 3/2016 | Imai | F04C 18/0215 418/55.5 |

FOREIGN PATENT DOCUMENTS

| | | |
|---|---|---|
| JP | 04-269388 | 9/1992 |
| JP | 11-182463 | 7/1999 |
| WO | 2005/064166 | 7/2005 |

* cited by examiner

SCROLL COMPRESSOR WITH MOVABLE NON-ORBITING SCROLL

TECHNICAL FIELD

The present invention relates to scroll compressors.

BACKGROUND ART

Recently, there is a known hermetic scroll compressor which includes a hermetic container in which a partition plate is provided and a low-pressure space separated by the partition plate accommodates a compression mechanism including a fixed scroll and an orbiting scroll and an electric motor that drives and rotates the orbiting scroll. In such a compressor, a boss portion of the fixed scroll is fitted in a retaining hole of the partition plate, and a refrigerant compressed by the compression mechanism is discharged through a discharge port of the fixed scroll into a high-pressure space separated by the partition plate (for example, see Patent Literature (PTL) 1).

In such a compressor, since the compression mechanism is provided in the low-pressure space, force is exerted on the fixed scroll and the orbiting scroll in opposite directions during operation of the compressor.

Therefore, in a known compressor, a chip seal is provided on a sealing surface between the fixed scroll and the orbiting scroll to improve the sealing properties of a compression chamber formed between the fixed scroll and the orbiting scroll.

In order to increase the efficiency of the compressor, however, it is preferred that the chip seal be eliminated and back pressure be applied to the orbiting scroll or the fixed scroll. Accordingly, there is another known compressor which applies back pressure to the fixed scroll and presses the fixed scroll against the orbiting scroll to improve the sealing properties of the compression chamber during operation of the compressor (for example, see PTL 2).

FIG. 14 is a vertical cross-sectional view of the scroll compressor disclosed in PTL 2. Compressor 111 includes fixed scroll 301, orbiting scroll 401, and electric motor 801. Compression chamber 501 is formed between fixed scroll 301 and orbiting scroll 401.

CITATION LIST

Patent Literature

PTL 1: Japanese Unexamined Patent Application Publication H11-182463

PTL 2: Japanese Unexamined Patent Application Publication H04-255586

SUMMARY OF THE INVENTION

Technical Problem

In conventional compressor 111, however, fixed scroll 301 is pressed against orbiting scroll 401 by its own weight as well. Therefore, compression chamber 501 has high sealing properties even when compressor 111 stops or starts operating. Thus, complete compression starts in compression chamber 501 immediately after the start-up, meaning that a large compression load is applied to electric motor 80. This results in the problem that when a single-phase motor with small starting torque is used as electric motor 801, it is difficult to start compressor 111.

Thus, the present invention provides a scroll compressor that can improve the startability.

Solution to Problem

In order to solve the aforementioned existing problem, the scroll compressor according to an aspect of the present invention includes: a partition plate that divides an inside of a hermetic container into a high-pressure space and a low-pressure space; a non-orbiting scroll provided in the low-pressure space and positioned adjacent to the partition plate; an orbiting scroll that engages the non-orbiting scroll and defines a compression chamber that is formed between the orbiting scroll and the non-orbiting scroll; a rotating shaft that causes the orbiting scroll to orbit; a main bearing that supports the orbiting scroll; and an elastic body that biases one of the non-orbiting scroll and the orbiting scroll in a direction in which the non-orbiting scroll and the orbiting scroll are spaced away from each other, wherein the one of the non-orbiting scroll and the orbiting scroll biased by the elastic body is movable between the partition plate and the main bearing in an axial direction of the rotating shaft.

Advantageous Effect of Invention

With the scroll compressor according to an aspect of the present invention, the fixed scroll and the orbiting scroll are biased in opposite directions, and therefore it is possible to improve the startability of the compressor by reducing the compression load upon the start-up.

DESCRIPTION OF EXEMPLARY EMBODIMENTS

Figure 1:
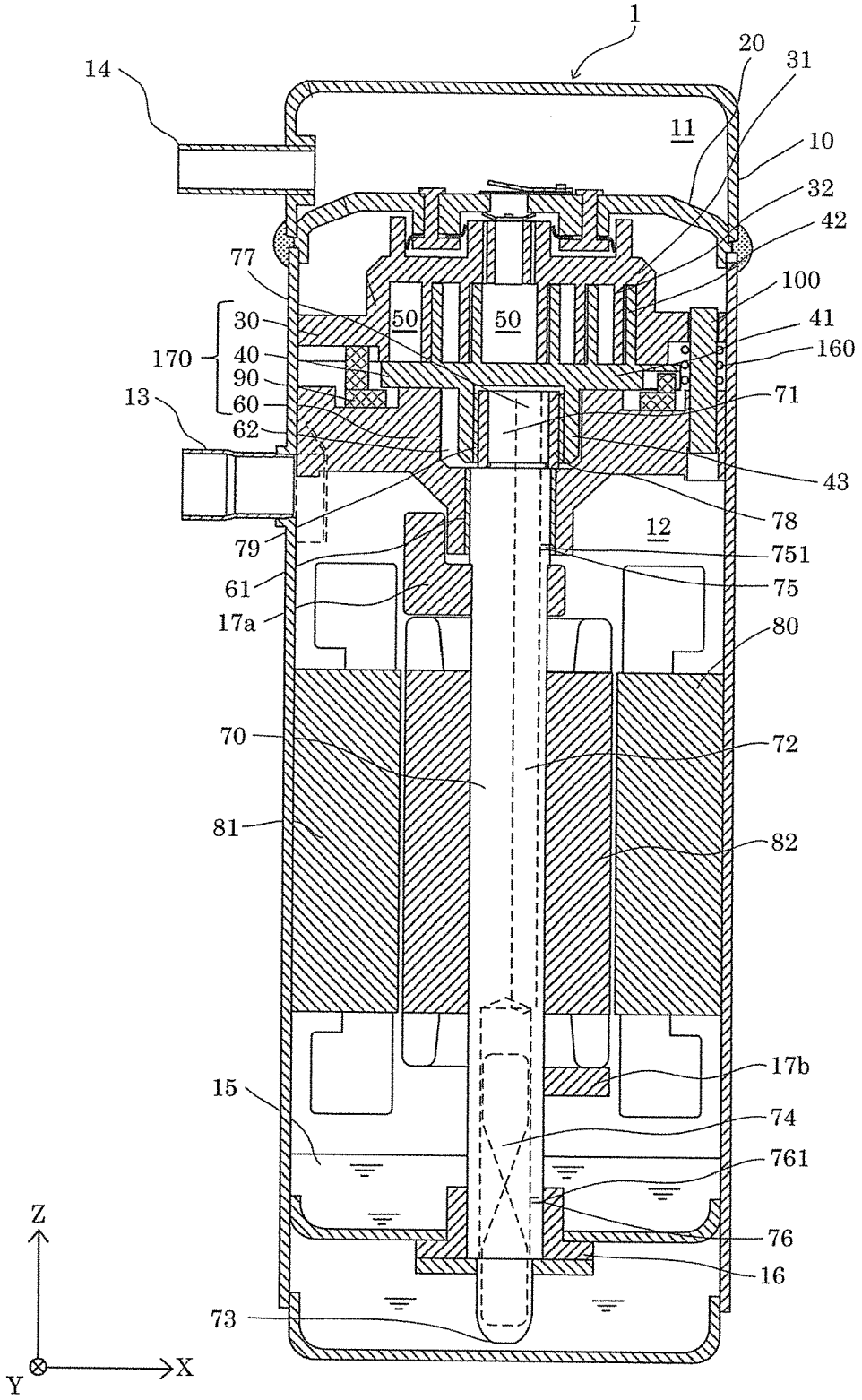
FIG. 1 is a vertical cross-sectional view of a scroll compressor according to an embodiment of the present invention.

The scroll compressor according to the first aspect of the present invention includes: a partition plate that divides an inside of a hermetic container into a high-pressure space and a low-pressure space; a non-orbiting scroll provided in the low-pressure space and positioned adjacent to the partition plate; an orbiting scroll that engages the non-orbiting scroll and defines a compression chamber that is formed between the orbiting scroll and the non-orbiting scroll; a rotating shaft that causes the orbiting scroll to orbit; a main bearing that supports the orbiting scroll; and an elastic body that biases one of the non-orbiting scroll and the orbiting scroll in a direction in which the non-orbiting scroll and the orbiting scroll are spaced away from each other, wherein the one of the non-orbiting scroll and the orbiting scroll biased by the elastic body is movable between the partition plate and the main bearing in an axial direction of the rotating shaft.

With this, upon the start-up of the compressor, a gap is formed between the non-orbiting scroll and the orbiting scroll, and therefore, immediately after the start-up, complete compression is not performed, meaning that the compression load can be reduced. Thus, it is possible to improve the startability of the compressor.

According to the second aspect of the present invention, in the first aspect of the present invention, the non-orbiting scroll is movable in the axial direction of the rotating shaft, and the elastic body is provided between the main bearing and the non-orbiting scroll.

With this, the elastic body does not orbit, meaning that it is possible to inhibit reduction in reliability and reduction in the efficiency of the compressor.

According to the third aspect of the present invention, in the second aspect of the present invention, the non-orbiting scroll and the partition plate are in contact with each other when the scroll compressor is not in operation.

With this, variations in the gap between the non-orbiting scroll and the orbiting scroll can be reduced.

According to the fourth aspect of the present invention, in the second or third aspect of the present invention, the non-orbiting scroll is pressed against the orbiting scroll by pressure in the high-pressure space when the scroll compressor is in operation.

With this, the non-orbiting scroll can be pressed against the orbiting scroll to just the right extent in a wide operation range, meaning that it is possible to improve the efficiency of the compressor while improving the startability.

According to the fifth aspect of the present invention, in any one of the second to fourth aspects of the present invention, the main bearing includes a columnar member that is inserted into and movable in a receiver of the non-orbiting scroll, and the elastic body covers the columnar member.

With this, it is possible to downsize the compression mechanism by saving space for installation. Furthermore, there is no need to provide a recess or the like for positioning the elastic body, meaning that it is possible to reduce the number of processing steps, and the assembly is facilitated.

According to the sixth aspect of the present invention, in any one of the first to fifth aspects of the present invention, the elastic body comprises a plurality of elastic bodies.

With this, it is possible to stably form a gap between the non-orbiting scroll and the orbiting scroll, and thus it is possible to further improve the startability.

According to the seventh aspect of the present invention, in the sixth aspect of the present invention, the plurality of elastic bodies are arranged at predetermined intervals in a circumferential direction of the rotating shaft.

With this, it is possible to provide a gap between the non-orbiting scroll and the orbiting scroll over the entire circumference of the scroll lap, and thus it is possible to further improve the startability.

According to the eighth aspect of the present invention, in any one of the first to seventh aspects of the present invention, the elastic body is a coil spring.

With this, variations in the reaction force of the elastic body due to variations in the assembly size of the compression mechanism can be reduced, and thus it is possible to more stably improve the startability.

According to the ninth aspect of the present invention, in any one of the first to eighth aspects of the present invention, the non-orbiting scroll includes a first end plate and a first spiral body that stands on the first end plate, the orbiting scroll includes a second end plate and a second spiral body that stands on the second end plate and engages the first spiral body, and a ratio of a gap between an end of the first spiral body and the second end plate to a height of the second spiral body is at least 0.005 and less than 0.1 when the scroll compressor is not in operation.

With this, immediately after the start-up of the compressor, complete compression is not performed, which allows a reduction in the compression load, and after the start-up, the gap between the non-orbiting scroll and the orbiting scroll is gradually reduced, and complete compression starts. Thus, it is possible to improve the efficiency of the compressor while improving the startability.

Hereinafter, embodiments of the present invention will be described with reference to the drawings. Note that the present invention is not limited to the embodiments.

Embodiment 1

FIG. 1 is a vertical cross-sectional view of a scroll compressor according to the present embodiment. Note that FIG. 1 illustrates a cross section along line III-III in FIG. 3. As illustrated in FIG. 1, compressor 1 includes cylindrical, vertically elongated hermetic container 10 as an outer casing. Note that the vertical direction herein is the Z-axis direction in FIG. 1 to FIG. 10, FIG. 12, and FIG. 13.

Compressor 1 is a hermetic scroll compressor including, inside hermetic container 10, compression mechanism 170 for compressing a refrigerant and electric motor 80 for driving compression mechanism 170. Compression mechanism 170 includes at least fixed scroll 30, orbiting scroll 40, main bearing 60, and Oldham ring 90.

Hermetic container 10 includes, in an upper inside area, partition plate 20 that vertically divides the inside of hermetic container 10. Partition plate 20 divides the inside of hermetic container 10 into high-pressure space 11 and low-pressure space 12. High-pressure space 11 is a space that is filled with a high-pressure refrigerant compressed in compression mechanism 170, and low-pressure space 12 is a space that is filled with a low-pressure refrigerant before the compression in compression mechanism 170.

Hermetic container 10 includes refrigerant inlet pipe 13 that allows communication between the outside of hermetic container 10 and low-pressure space 12 and refrigerant outlet pipe 14 that allows communication between the outside of hermetic container 10 and high-pressure space 11. In compressor 1, a low-pressure refrigerant is introduced into low-pressure space 12 from a refrigeration cycle circuit (not illustrated in the drawings) provided outside of hermetic container 10 through refrigerant inlet pipe 13. A high-pressure refrigerant compressed in compression mechanism 170 is first introduced into high-pressure space 11. The high-pressure refrigerant is thereafter discharged from high-pressure space 11 into the refrigeration cycle circuit through refrigerant outlet pipe 14.

Oil reservoir 15 in which lubricant is stored is formed at the bottom of low-pressure space 12.

Compressor 1 includes fixed scroll 30 and orbiting scroll 40 in low-pressure space 12. Fixed scroll 30 is a non-orbiting scroll in the present invention. Fixed scroll 30 is provided below and adjacent to partition plate 20. Orbiting scroll 40 is provided below and in engagement with fixed scroll 30.

Fixed scroll 30 includes disc-shaped fixed scroll end plate 31 and spiral-shaped fixed scroll lap 32 standing on the lower surface of fixed scroll end plate 31.

Orbiting scroll 40 includes disc-shaped orbiting scroll end plate 41, spiral-shaped orbiting scroll lap 42 standing on the upper surface of orbiting scroll end plate 41, and lower boss portion 43. Lower boss portion 43 is a cylindrical protrusion formed at the approximate center of the lower surface of orbiting scroll end plate 41.

Fixed scroll end plate 31 is a first end plate in the present invention, and fixed scroll lap 32 is a first spiral body in the present invention. Orbiting scroll end plate 41 is a second end plate in the present invention, and orbiting scroll lap 42 is a second spiral body in the present invention.

Orbiting scroll lap 42 of orbiting scroll 40 and fixed scroll lap 32 of fixed scroll 30 engage each other to form compression chamber 50 between orbiting scroll 40 and fixed scroll 30. Compression chamber 50 is formed along each of the inner wall (to be described later) and the outer wall (to be described later) of orbiting scroll lap 42.

Main bearing 60 that supports orbiting scroll 40 is provided below fixed scroll 30 and orbiting scroll 40. Main bearing 60 includes boss housing portion 62 at the approximate center of the upper surface and bearing portion 61 below boss housing portion 62. Boss housing portion 62 is a recess for housing lower boss portion 43. Bearing portion 61 is a through hole, the upper end of which is opened in boss housing portion 62 and the lower end of which is opened in low-pressure space 12.

Main bearing 60 supports orbiting scroll 40 by the upper surface and pivotally supports rotating shaft 70 by bearing portion 61.

Rotating shaft 70 is a vertically elongated shaft in FIG. 1. Rotating shaft 70 is pivotally supported by bearing portion 61 on one end side and is pivotally supported by auxiliary bearing 16 on the other end side. Auxiliary bearing 16 is a bearing provided below low-pressure space 12 and desirably inside oil reservoir 15. Eccentric shaft 71 that is eccentric with respect to the core of rotating shaft 70 is provided at the upper end of rotating shaft 70. Eccentric shaft 71 is slidably inserted to lower boss portion 43 via swing bush 78 and orbiting bearing 79. Lower boss portion 43 is rotatably driven by eccentric shaft 71.

Rotating shaft 70 includes therein oil passage 72 through which lubricant passes. Oil passage 72 is a through hole formed in the axial direction of rotating shaft 70. One end of oil passage 72 is opened inside oil reservoir 15 as inlet 73 provided at the lower end of rotating shaft 70. Paddle 74 that draws lubricant up from inlet 73 into oil passage 72 is provided above inlet 73.

Furthermore, rotating shaft 70 includes first branch oil passage 751 and second branch oil passage 761 therein. First branch oil passage 751 is opened through the bearing surface of bearing portion 61 at one end as first oil supply inlet 75 and communicates with oil passage 72 on the other end side. Second branch oil passage 761 is opened through the bearing surface of auxiliary bearing portion 16 at one end as second oil supply inlet 76 and communicates with oil passage 72 on the other end side.

In addition, the upper end of oil passage 72 is opened inside boss housing portion 62 as third oil supply inlet 77.

Rotating shaft 70 is connected to electric motor 80. Electric motor 80 is provided between main bearing 60 and auxiliary bearing 16. Electric motor 80 is a single-phase alternating-current motor which is driven with single-phase alternating-current power. Electric motor 80 includes stator 81 fixed to hermetic container 10 and rotor 82 provided inside stator 81.

Rotating shaft 70 is fixed to rotor 82. Rotating shaft 70 includes balance weight 17*a* above rotor 82 and balance weight 17*b* below rotor 82. Balance weight 17*a* and balance weight 17*b* are arranged in positions offset by 180 degrees in the circumferential direction of rotating shaft 70.

Rotating shaft 70 rotates with a balance between centrifugal force generated by balance weight 17*a* and balance weight 17*b* and centrifugal force generated in the orbital motion of orbiting scroll 40. Note that balance weight 17*a* and balance weight 17*b* may be provided on rotor 82.

Rotation restricting member (Oldham ring) 90 is provided between orbiting scroll 40 and main bearing 60. Oldham ring 90 prevents orbiting scroll 40 from rotating. With this, orbiting scroll 40 orbits with respect to fixed scroll 30 without rotating.

Fixed scroll 30, orbiting scroll 40, electric motor 80, Oldham ring 90, and main bearing 60 are provided in low-pressure space 12. In particular, fixed scroll 30 and orbiting scroll 40 are provided between partition plate 20 and main bearing 60.

Elastic body 160 is provided on compression mechanism 170 including at least fixed scroll 30, orbiting scroll 40, main bearing 60, and Oldham ring 90. Specifically, elastic body 160 that biases fixed scroll 30 and orbiting scroll 40 away from each other is provided on one of fixed scroll 30 and orbiting scroll 40.

Partition plate 20 and main bearing 60 are fixed to hermetic container 10. At least one of fixed scroll 30 and orbiting scroll 40 on which elastic body 160 is provided in such a way as to be axially movable at least in part of the area between partition plate 20 and main bearing 60 and more specifically between partition plate 20 and orbiting scroll 40 or between fixed scroll 30 and main bearing 60.

More specifically, fixed scroll 30 is provided in such a way as to be axially (vertically in FIG. 1) movable relative to columnar member 100 provided on main bearing 60. Columnar member 100 has a lower end fixedly inserted into bearing-side hole 102 (see FIG. 6 to be described later) and an upper end slidably inserted into scroll-side hole 101 (see FIG. 3 to FIG. 5 to be described later).

Columnar member 100 regulates the rotation and radial movement of fixed scroll 30 and allows the axial movement of fixed scroll 30. Specifically, fixed scroll 30 is supported on main bearing 60 by columnar member 100 and is axially movable at least in part of the area between partition plate 20 and main bearing 60 and more specifically between partition plate 20 and orbiting scroll 40.

Two or more columnar members 100 are arranged circumferentially at predetermined intervals. It is desirable that two or more columnar members 100 be arranged circumferentially at equal intervals.

Note that columnar member 100 may be provided on fixed scroll 30. Specifically, columnar member 100 may have a lower end slidably inserted into bearing-side hole 102 (see FIG. 6 to be described later) and an upper end fixedly inserted into scroll-side hole 101 (see FIG. 3 to FIG. 5 to be described later).

Operations and functions of compressor 1 are described. Rotating shaft 70 rotates along with rotor 82 by electric motor 80 being driven. Due to eccentric shaft 71 and Oldham ring 90, orbiting scroll 40 does not rotate, but orbits around the central axis of rotating shaft 70. Thus, the volume of compression chamber 50 is reduced, and a refrigerant in compression chamber 50 is compressed.

The refrigerant is introduced from refrigerant inlet pipe 13 into low-pressure space 12. The refrigerant in low-pressure space 12 is guided from the outer periphery of orbiting scroll 40 to compression chamber 50. The refrigerant compressed in compression chamber 50 is discharged from refrigerant outlet pipe 14 through high-pressure space 11.

The lubricant stored in oil reservoir 15 is drawn upward in oil passage 72 along paddle 74 from inlet 73 by rotation of rotating shaft 70. The drawn lubricant is supplied from first oil supply inlet 75, second oil supply inlet 76, and third oil supply inlet 77 to bearing portion 61, auxiliary bearing 16, and boss housing portion 62, respectively. The lubricant drawn up to boss housing portion 62 is guided to the sliding surface between main bearing 60 and orbiting scroll 40 and discharged back to oil reservoir 15 through return passage 63 (see FIG. 6 to be described later).

Figure 2:
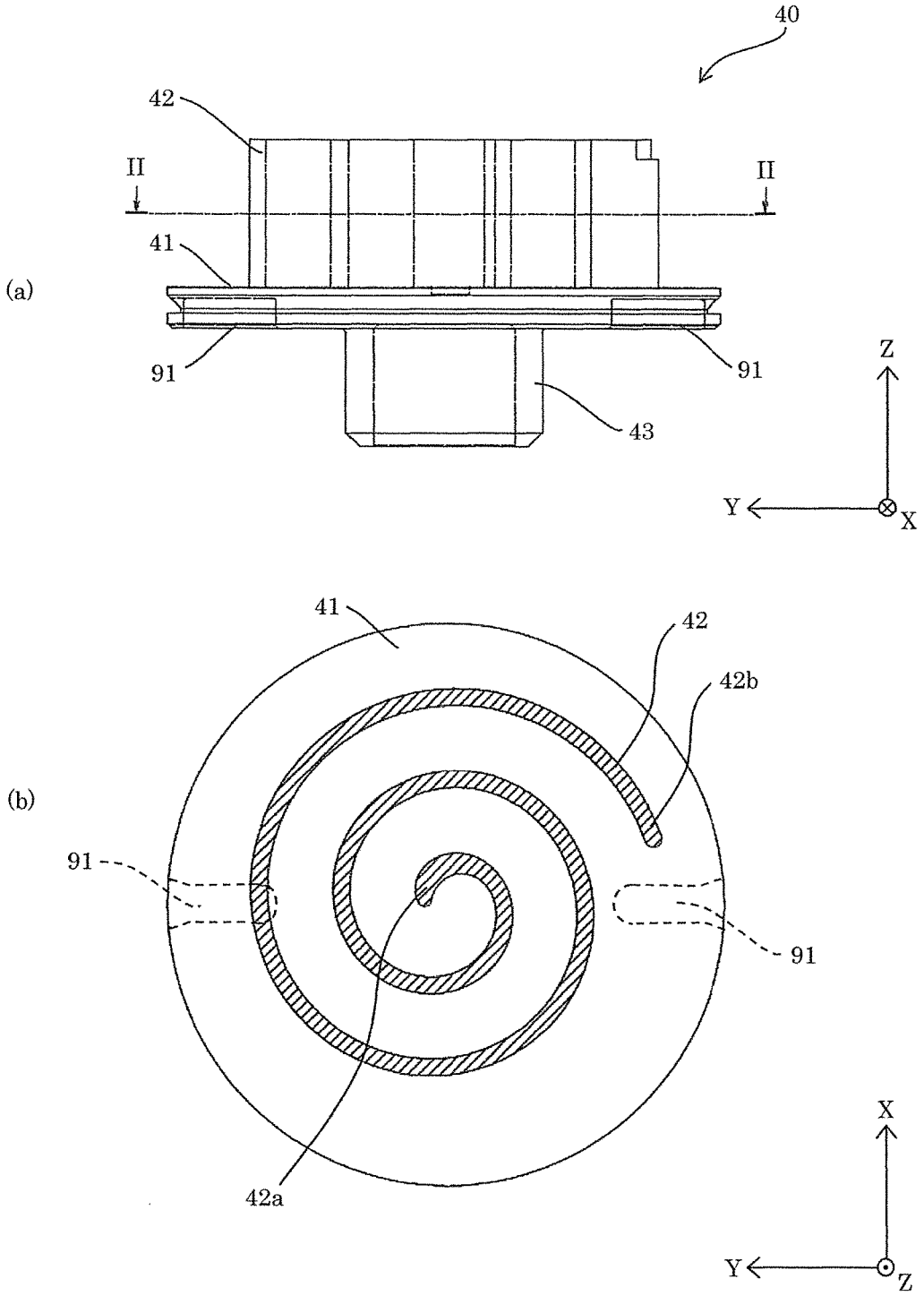
FIG. 2 includes, in (a), a side view of an orbiting scroll of the scroll compressor according to the embodiment, and in (b), a cross-sectional view taken along line II-II in (a) of FIG. 2.

The configuration of compressor 1 is further described in detail. In FIG. 2, (a) is a side view of the orbiting scroll of the scroll compressor according to the present embodiment. In FIG. 2, (b) is a cross-sectional view taken along line II-II in (a) of FIG. 2.

Orbiting scroll lap 42 is a wall, the cross section of which is defined by an involute curve having a winding starting point at origin 42*a* in the central area of orbiting scroll end plate 41 with a radius that gradually increases with distance therefrom to terminal end 42*b* located on the outer circumference side. Orbiting scroll lap 42 has a predetermined height (vertical length) and a predetermined wall thickness (length in the radial direction of orbiting scroll lap 42).

The lower surface of orbiting scroll end plate 41 has, on opposite edges, a pair of first key grooves 91 elongated from the outer periphery toward the center of orbiting scroll end plate 41.

Figure 3:
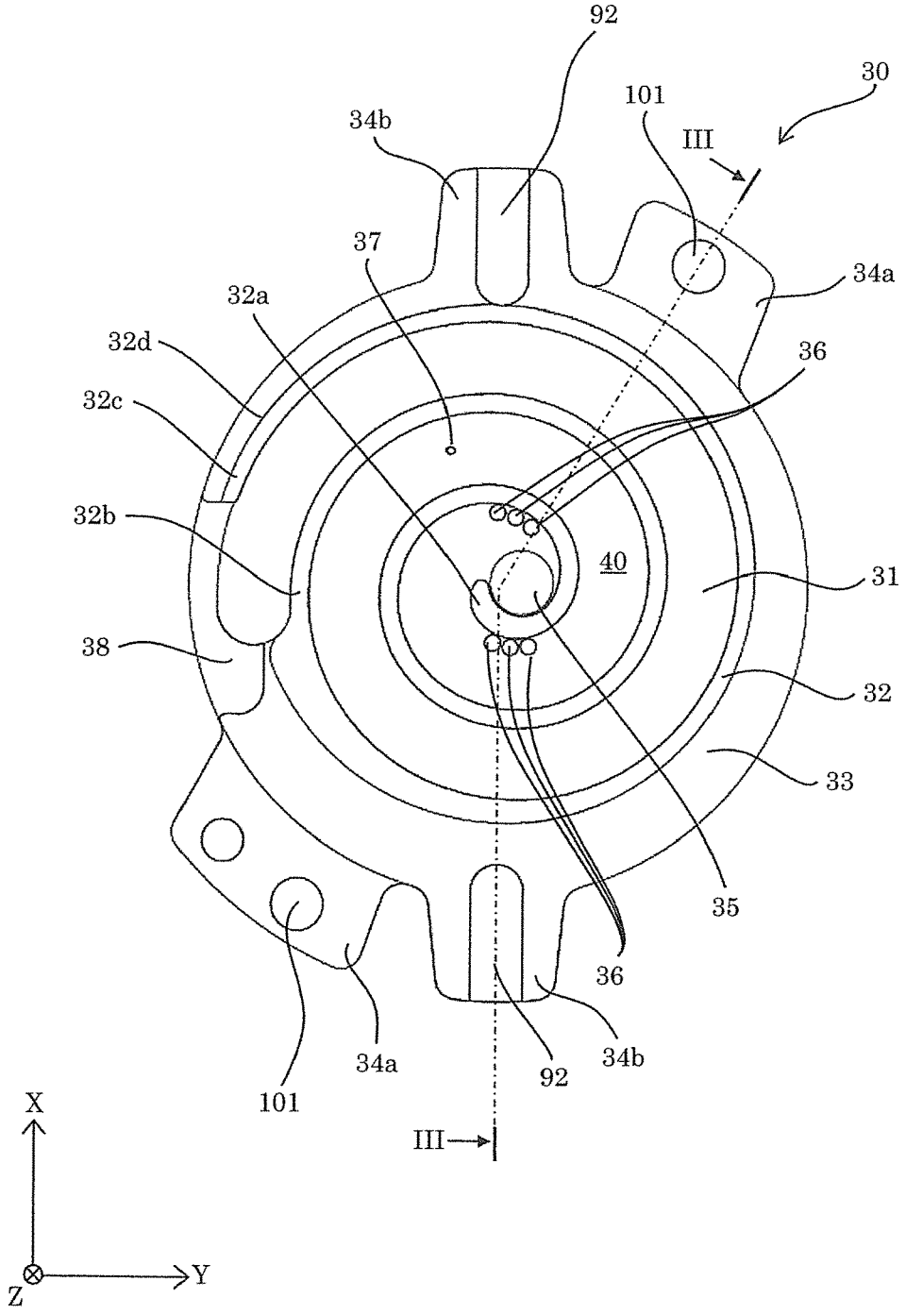
FIG. 3 is a bottom view of a fixed scroll of the scroll compressor according to the embodiment.
Figure 4:
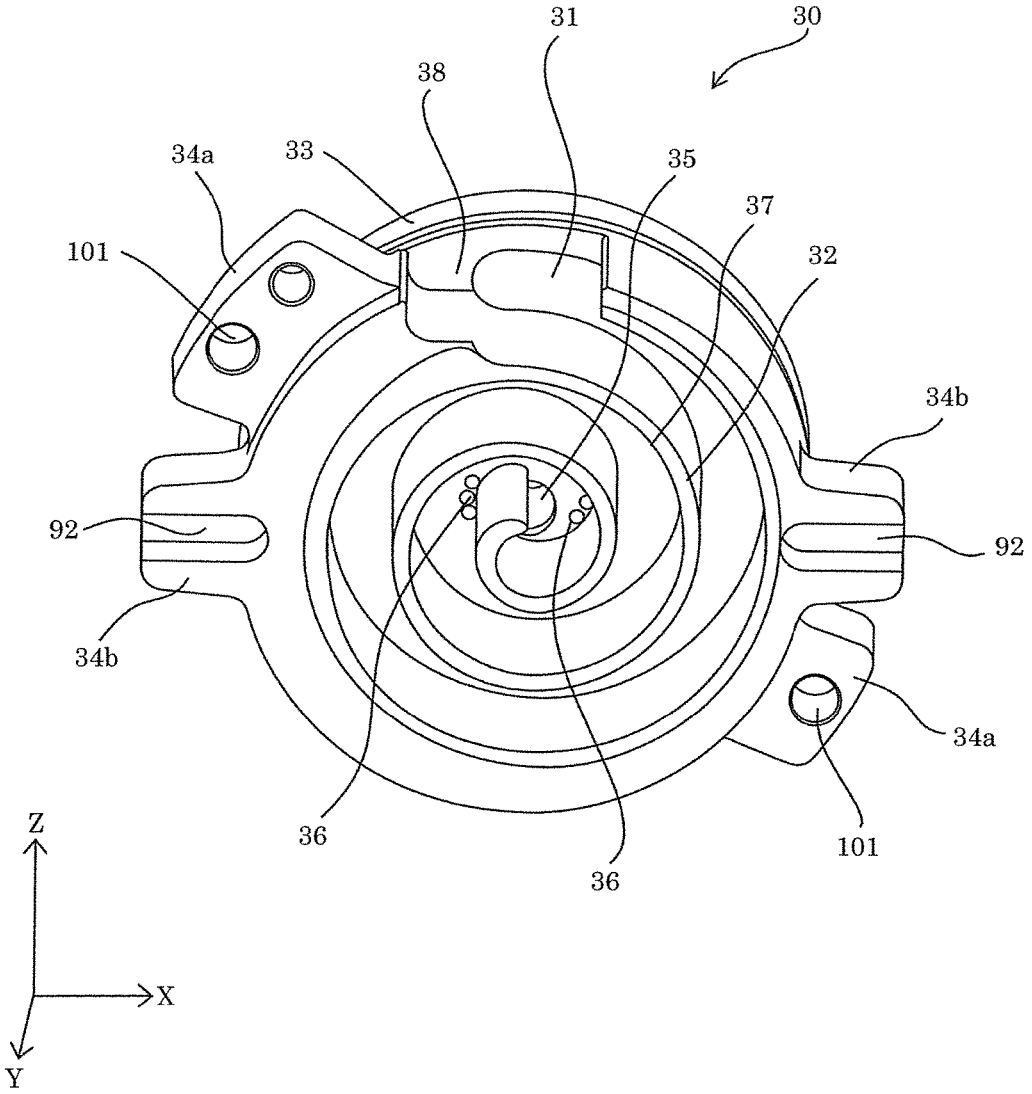
FIG. 4 is a perspective view of the fixed scroll from the bottom surface side.
Figure 5:
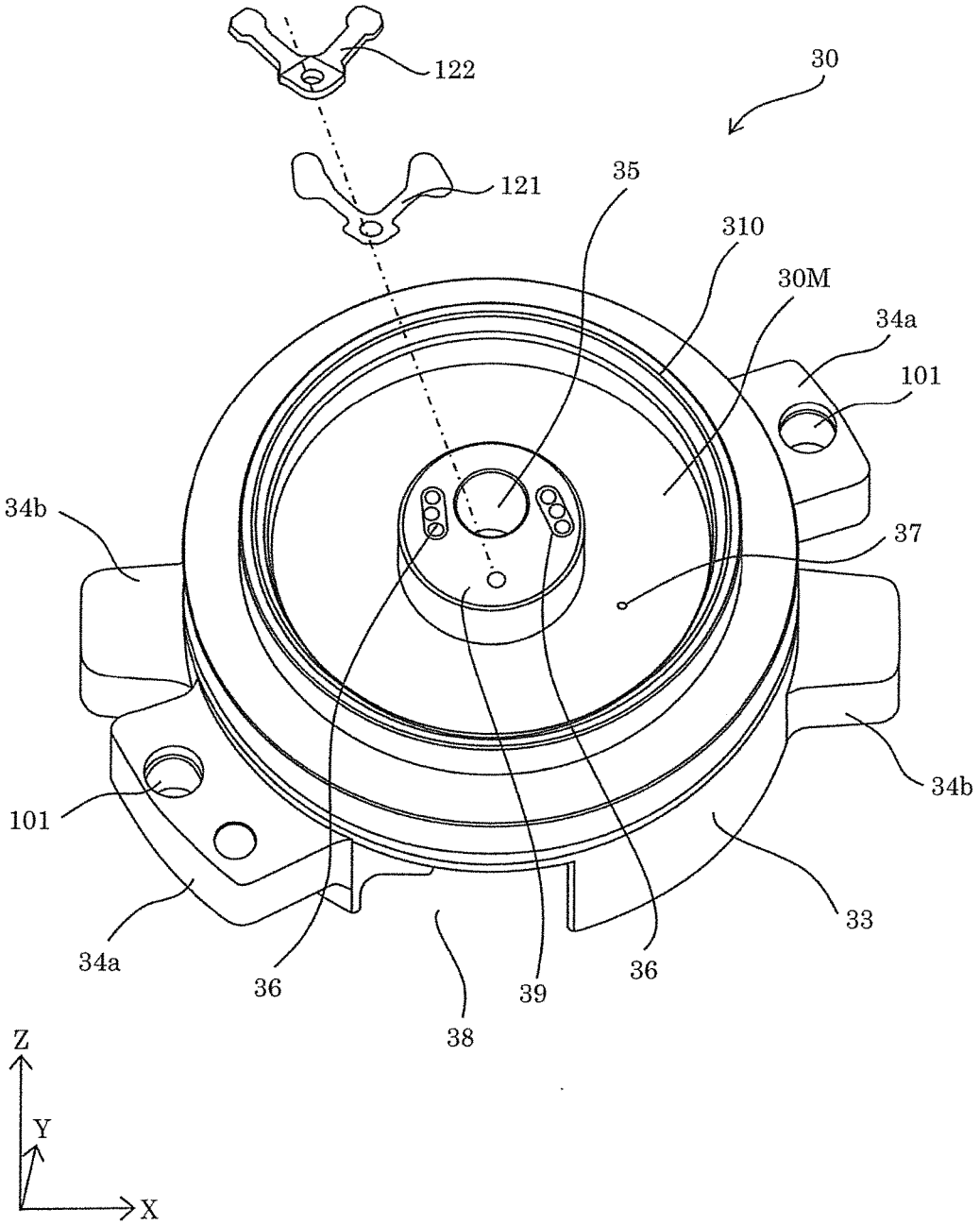
FIG. 5 is an exploded perspective view of the fixed scroll from the upper surface side.

FIG. 3 is a bottom view of the fixed scroll of the scroll compressor according to the present embodiment. FIG. 4 is a perspective view of the fixed scroll from the bottom surface side. FIG. 5 is an exploded perspective view of the fixed scroll from the upper surface side.

As illustrated in FIG. 3 to FIG. 5, fixed scroll lap 32 is a wall, the cross section of which is defined by an involute curve having a winding starting point at origin 32*a* in the central arear of fixed scroll end plate 31 with a radius that gradually increases with distance therefrom to terminal end 32*c* located on the outer circumference side. Fixed scroll lap 32 has a predetermined height (vertical length) and a predetermined wall thickness (length in the radial direction of fixed scroll lap 32) that are equal to those of orbiting scroll lap 42.

Fixed scroll lap 32 includes an inner wall (a center-side wall surface) and an outer wall (an outer circumference-side wall surface) from origin 32*a* to intermediate portion 32*b* and includes only the inner wall from intermediate portion 32*b* to terminal end 32*c*.

First discharge port 35 is formed at the approximate center of fixed scroll end plate 31. Bypass port 36 and intermediate-pressure port 37 are formed in fixed scroll end plate 31. Bypass port 36 is provided in a region in the neighborhood of first discharge port 35 where a high-pressure refrigerant immediately before completion of compression is present. Assuming that one set of bypass port 36 has three small holes, two sets of bypass port 36 are provided, one of which communicates with compression chamber 50 formed along the outer wall of orbiting scroll lap 42 and the other of which communicates with compression chamber 50 formed along the inner wall of orbiting scroll lap 42. Intermediate-pressure port 37 is provided in a region in the neighborhood of intermediate portion 32*b* where an intermediate-pressure refrigerant in the middle of compression is present.

Fixed scroll 30 includes, in the outer periphery, a pair of first flanges 34*a* and a pair of second flanges 34*b* that protrude outward from peripheral wall 33. First flanges 34*a* and second flanges 34*b* are provided below fixed scroll end plate 31 (on the orbiting scroll 40 side). Second flanges 34*b* are provided below first flanges 34*a*, and the lower surface (the orbiting scroll 40-side surface) of each of second flanges 34*b* is substantially flush with an end surface of fixed scroll lap 32.

Paired first flanges 34*a* are arranged at predetermined, approximately equal intervals in the circumferential direction of rotating shaft 70. Paired second flanges 34*b* are arranged at predetermined, approximately equal intervals in the circumferential direction of rotating shaft 70.

Peripheral wall 33 of fixed scroll 30 includes inlet portion 38 for drawing a refrigerant into compression chamber 50.

Furthermore, first flanges 34*a* each has scroll-side hole 101 into which the upper end of columnar member 100 is inserted. One scroll-side hole 101 is provided in each of paired first flanges 34*a*. Scroll-side hole 101 is a receiver in the present invention. Two scroll-side holes 101 are arranged circumferentially at predetermined intervals. It is desirable that two scroll-side holes 101 be arranged circumferentially at equal intervals. Note that other than a through hole, scroll-side hole 101 may be a recess in the lower surface.

Scroll-side hole 101 communicates with the outside of fixed scroll 30, specifically, with low-pressure space 12, through a hole for communicative connection (not illustrated in the drawings).

Second flanges 34*b* have second key grooves 92. Second key grooves 92 are a pair of grooves that are provided on the pair of second flanges 34*b* in one-to-one correspondence and elongated from the outer periphery toward the center.

As illustrated in FIG. 5, upper boss portion 39 is provided at the center of the upper surface (the partition plate 20-side surface) of fixed scroll 30. Upper boss portion 39 is a circular columnar protrusion extending from the upper surface of fixed scroll 30. First discharge port 35 and bypass port 36 are opened in the upper surface of upper boss portion 39. Discharge space 30H is formed on the upper surface side of upper boss portion 39, between upper boss portion 39 and partition plate 20 (see FIG. 8 to be described later). First discharge port 35 and bypass port 36 communicate with discharge space 30H.

Furthermore, on the upper surface of fixed scroll 30, ring-shaped protrusion 310 is provided around the outer periphery of upper boss portion 39. Upper boss portion 39 and ring-shaped protrusion 310 form a recess on the upper surface of fixed scroll 30. This recess forms intermediate-pressure space 30M (see FIG. 8 to be described later). Intermediate-pressure port 37 is opened in the upper surface (the bottom surface of the recess) of fixed scroll 30 and communicates with intermediate-pressure space 30M.

The opening diameter of intermediate-pressure port 37 is smaller than the wall thickness of orbiting scroll lap 42. With this, compression chamber 50 formed along the inner wall of orbiting scroll lap 42 and compression chamber 50 formed along the outer wall of orbiting scroll lap 42 are prevented from communicating with each other.

Bypass check valve 121 that makes it possible to open and close bypass port 36 and bypass check valve stop 122 that prevents excessive deformation of bypass check valve 121 are provided on the upper surface of upper boss portion 39. It is possible to downsize bypass check valve 121 in the height direction by using a reed valve as bypass check valve 121. When a V-shaped reed valve is used as bypass check valve 121, it is possible to open and close, by a single reed valve, bypass port 36 that communicates with compression chamber 50 formed along the outer wall of orbiting scroll lap 42 and bypass port 36 that communicates with compression chamber 50 formed along the inner wall of orbiting scroll lap 42.

An intermediate-pressure check valve (not illustrated in the drawings) that makes it possible to open and close intermediate-pressure port 37 and an intermediate-pressure check valve stop (not illustrated in the drawings) that prevents excessive deformation of the intermediate-pressure check value are provided on the upper surface (the bottom surface of the recess) of fixed scroll 30. It is possible to downsize the intermediate-pressure check valve in the height direction by using a reed valve as the intermediate-pressure check valve. The intermediate-pressure check valve can be made up of a ball valve and a spring.

Figure 6:
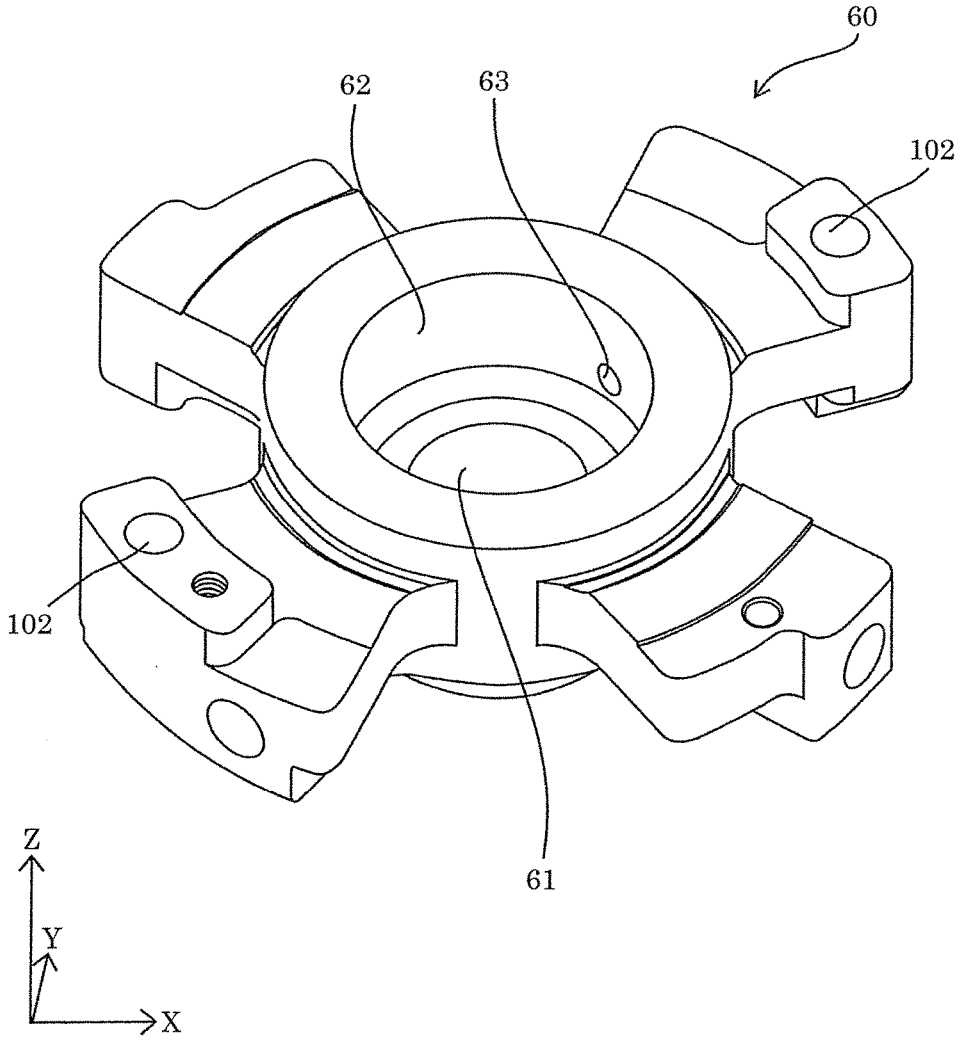
FIG. 6 is a perspective view of a main bearing of the scroll compressor according to the embodiment from the upper surface side.

FIG. 6 is a perspective view of the main bearing of the scroll compressor according to the present embodiment from the upper surface side.

The outer periphery of main bearing 60 has bearing-side hole 102 into which the lower end of columnar member 100 is inserted. Two bearing-side holes 102 are arranged circumferentially at predetermined intervals. It is desirable that two bearing-side holes 102 be arranged circumferentially at equal intervals. Note that other than a through hole, bearing-side hole 102 may be a recess in the upper surface.

Return passage 63 having one end opened in boss housing portion 62 and the other end opened in the lower surface of main bearing 60 is formed in main bearing 60. Note that one end of return passage 63 may be opened in the upper surface of main bearing 60. The other end of return passage 63 may be opened in the side surface of main bearing 60.

Return passage 63 communicates with bearing-side hole 102. Therefore, lubricant is supplied to bearing-side hole 102 through return passage 63.

Figure 7:
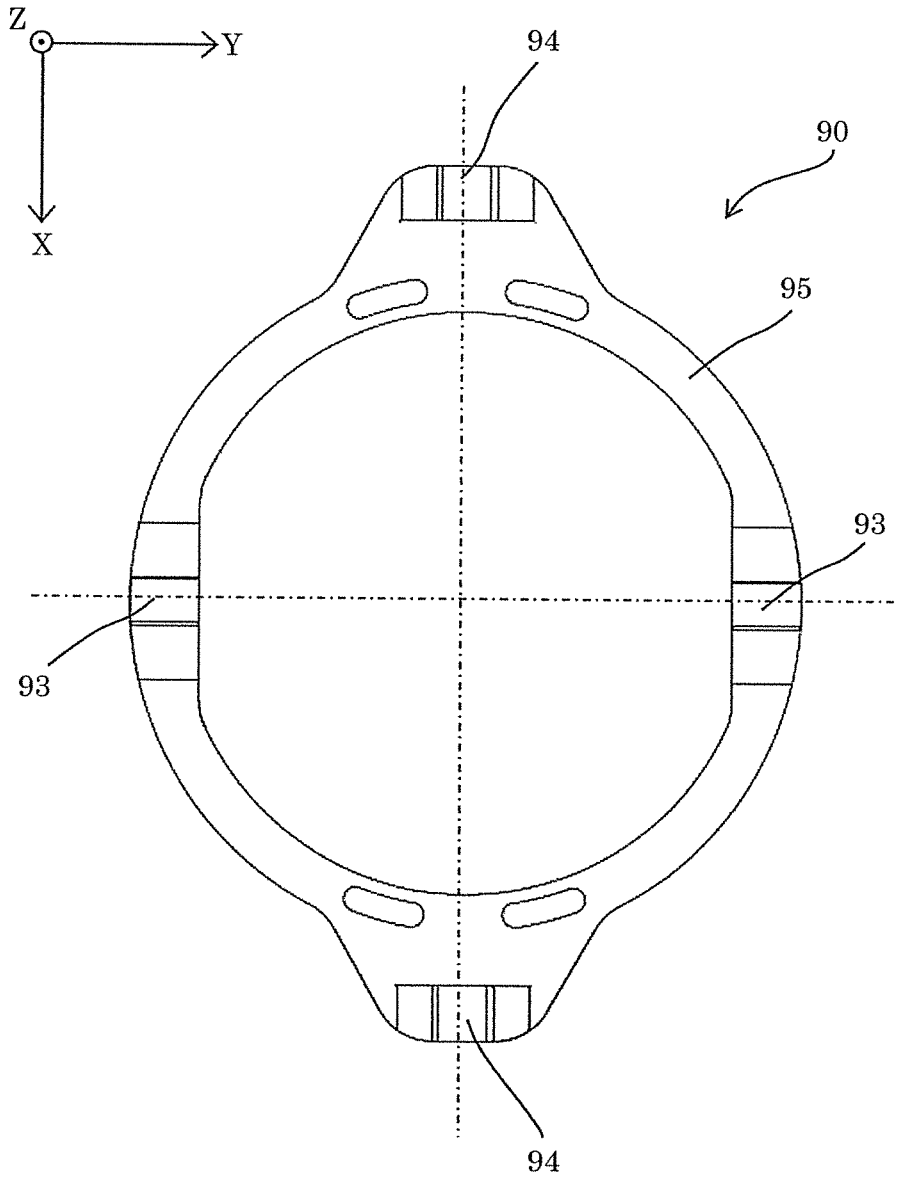
FIG. 7 is a top view of an Oldham ring of the scroll compressor according to the embodiment.

FIG. 7 is a top view of the Oldham ring of the scroll compressor according to the present embodiment.

Oldham ring 90 includes ring portion 95 having a substantially circular annular shape and a pair of first keys 93 and a pair of second keys 94 that protrude from the upper surface of ring portion 95. First keys 93 and second keys 94 are arranged in such a way that the straight line connecting two first keys 93 and the straight line connecting two second keys 94 are orthogonal to each other.

First keys 93 engage first key grooves 91 of orbiting scroll 40, and second keys 94 engage second key grooves 92 of fixed scroll 30. This allows orbiting scroll 40 to orbit with respect to fixed scroll 30 without rotating.

In the present embodiment, fixed scroll 30, orbiting scroll 40, and Oldham ring 90 are arranged in the stated order from above in the axial direction of rotating shaft 70. Thus, first keys 93 and second keys 94 are formed flush with ring portion 95. In this case, at the time of manufacture of Oldham ring 90, it is possible to process first keys 93 and second keys 94 in the same direction, meaning that the number of times Oldham ring 90 is attached to and detached from a processing machine can be reduced. Accordingly, it is possible to obtain the effect of improving the processing accuracy and reducing the processing cost for Oldham ring 90.

Figure 8:
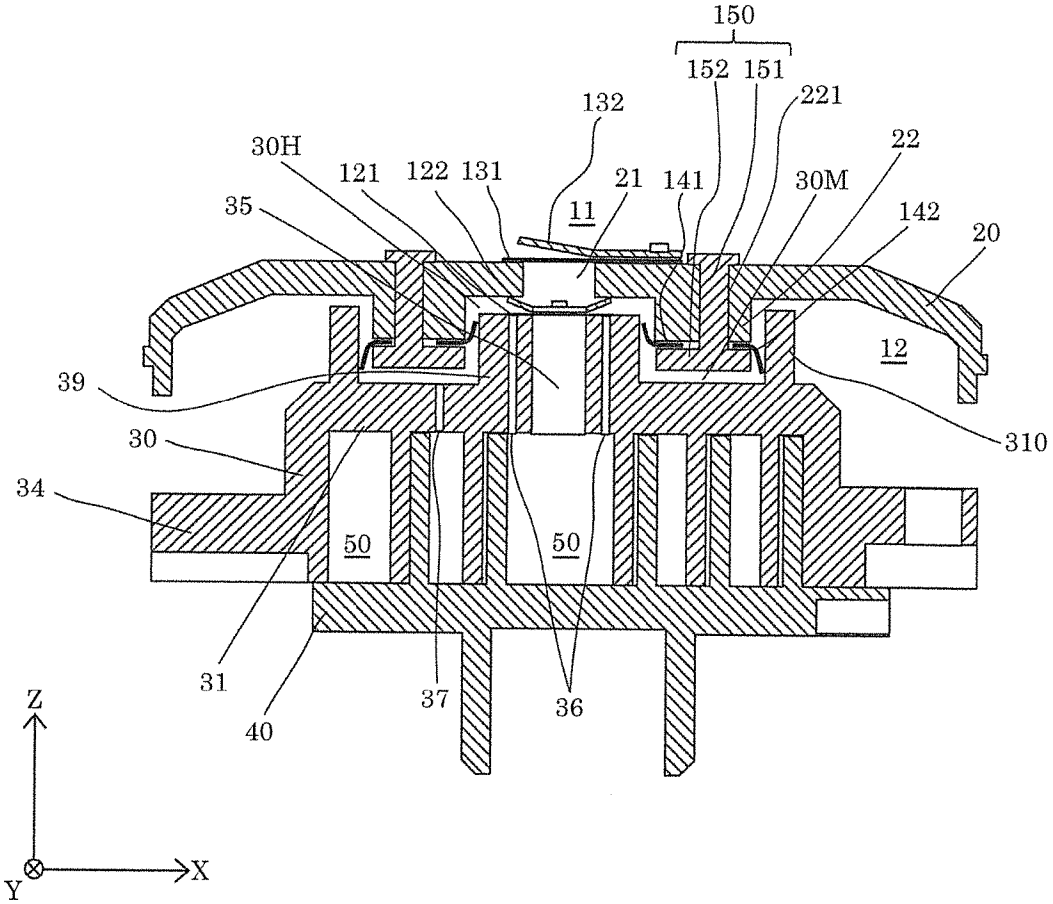
FIG. 8 is a cross-sectional view of a relevant portion of the scroll compressor according to the embodiment.
Figure 9:
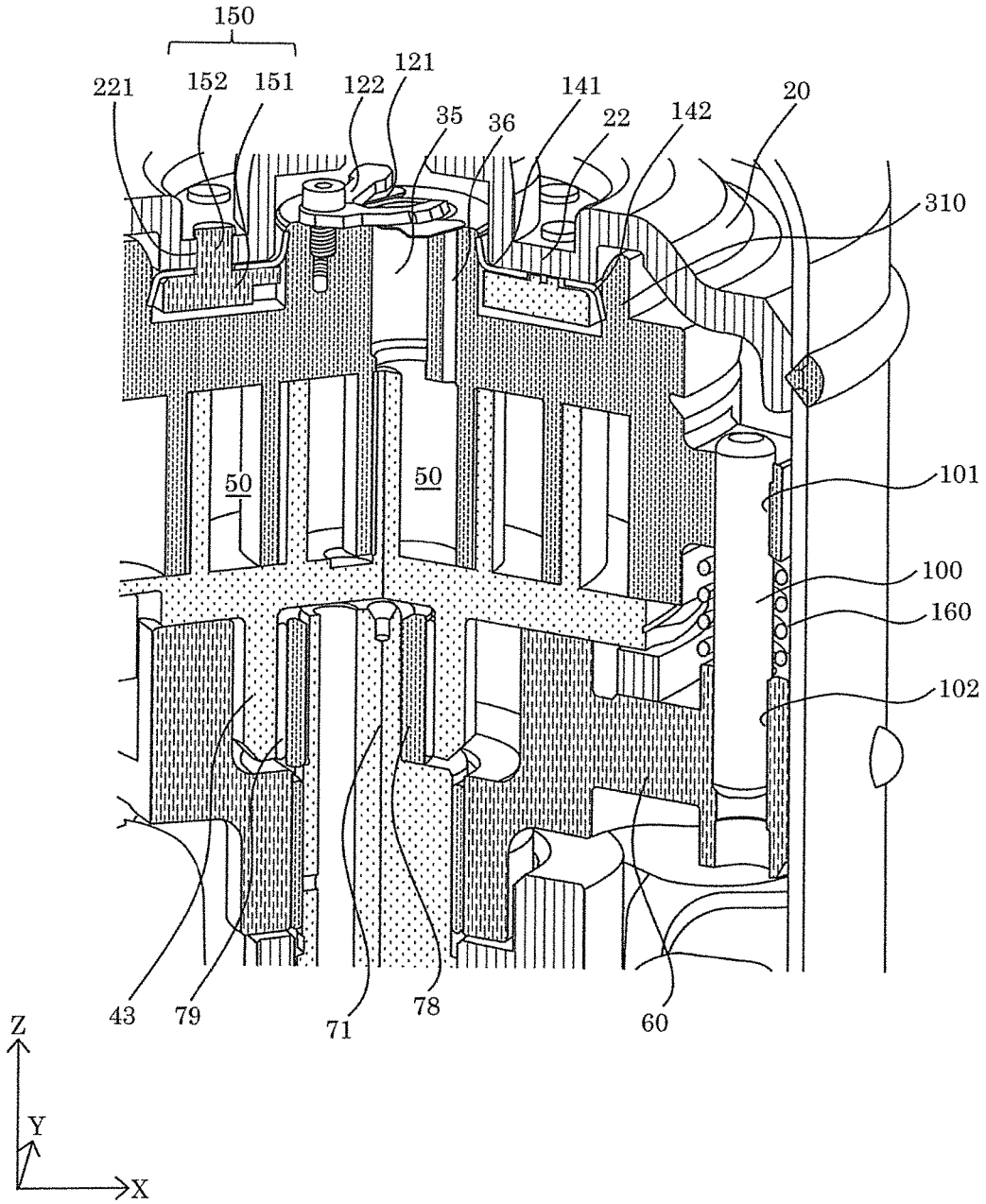
FIG. 9 is a cross-sectional perspective view of a relevant portion of the scroll compressor according to the embodiment.

FIG. 8 is a cross-sectional view of a relevant portion of the scroll compressor according to the present embodiment. FIG. 9 is a cross-sectional perspective view of a relevant portion of the hermetic scroll compressor according to the present embodiment.

Second discharge port 21 is provided at the center of partition plate 20. Discharge check valve 131 that makes it possible to open and close second discharge port 21 and discharge check valve stop 132 that prevents excessive deformation of discharge check valve 131 are provided on the upper surface of partition plate 20.

Discharge space 30H is formed between partition plate 20 and fixed scroll 30. Discharge space 30H communicates with compression chamber 50 through first discharge port 35 and bypass port 36 and communicates with high-pressure space 11 through second discharge port 21.

Since discharge space 30H communicates with high-pressure space 11 through second discharge port 21, back pressure is applied to the upper surface of fixed scroll 30. Specifically, when high pressure is applied to discharge space 30H, fixed scroll 30 is pressed against orbiting scroll 40. Thus, the gap between fixed scroll 30 and orbiting scroll 40 can disappear, and compressor 1 can perform highly-efficient operations.

Furthermore, since aside from first discharge port 35, bypass port 36 that allows communication between compression chamber 50 and discharge space 30H and bypass check valve 121 provided on bypass port 36 are included, it is possible to guide a refrigerant from compression chamber 50 to discharge space 30H at a point in time when the pressure in compression chamber 50 reaches a predetermined level, while preventing backflow from discharge space 30H. Thus, excessive compression of the refrigerant in compression chamber 50 can be restrained, and compressor 1 can perform highly efficient operations in a wide operation range.

The board thickness of discharge check valve 131 is greater than the board thickness of bypass check valve 121. With this, it is possible to prevent discharge check valve 131 from opening before bypass check valve 121 opens.

The volume of second discharge port 21 is greater than the volume of first discharge port 35. With this, it is possible to reduce the pressure loss of the refrigerant that is discharged from compression chamber 50.

Second discharge port 21 may be tapered on the inflow side. With this, it is possible to further reduce the pressure loss.

On the lower surface of partition plate 20, projecting portion 22 that protrudes in a circular annular shape is provided around second discharge port 21. Projecting portion 22 has two or more holes 221 into each of which a part of blocking member 150 (to be described later) is inserted.

First sealing member 141 and second sealing member 142 are provided on projecting portion 22. First sealing member 141 is a ring-shaped sealing member that protrudes from projecting portion 22 toward the center of partition plate 20. The distal end of first sealing member 141 is in contact with the side surface of upper boss portion 39. In other words, first sealing member 141 is provided in a gap located between partition plate 20 and fixed scroll 30 and around discharge space 30H.

Second sealing member 142 is a ring-shaped sealing member that protrudes from projecting portion 22 toward the outer periphery of partition plate 20. Second sealing member 142 is provided outside first sealing member 141. The distal end of second sealing member 142 is in contact with the inner side of ring-shaped protrusion 310. In other words, second sealing member 142 is provided in a gap located between partition plate 20 and fixed scroll 30 and around intermediate-pressure space 30M.

To put it another way, first sealing member 141 and second sealing member 142 form discharge space 30H and intermediate-pressure space 30M between partition plate 20 and fixed scroll 30. Discharge space 30H is formed on the upper surface side of upper boss portion 39, and intermediate-pressure space 30M is formed on the outer circumference side of upper boss portion 39.

First sealing member 141 is a sealing member that separates discharge space 30H and intermediate-pressure space 30M from each other, and second sealing member 142 is a sealing member that separates intermediate-pressure space 30M and low-pressure space 12 from each other.

For example, polytetrafluoroethylene, which is a fluororesin, is suitable for first sealing member 141 and second sealing member 142 in terms of sealing properties and the ease of assembly. Furthermore, mixing a fiber material into a fluororesin for first sealing member 141 and second sealing member 142 improves the reliability of sealing.

First sealing member 141 and second sealing member 142 are sandwiched between blocking member 150 and projecting portion 22.

Therefore, partition plate 20 can be placed inside hermetic container 10 after first sealing member 141, second sealing member 142, and blocking member 150 are assembled on partition plate 20. Thus, the number of components can be small, and the scroll compressor can be easily assembled.

More specifically, blocking member 150 includes ring-shaped portion 151 provided opposite projecting portion 22 of partition plate 20 and two or more projecting portions 152 that protrude from one surface of ring-shaped portion 151.

An outer circumference part of first sealing member 141 is sandwiched between an inner circumference part of the upper surface of ring-shaped portion 151 and the lower surface of projecting portion 22. An inner circumference part of second sealing member 142 is sandwiched between an outer circumference part of the upper surface of ring-shaped portion 151 and the lower surface of projecting portion 22.

In other words, ring-shaped portion 151 is located opposite the lower surface of projecting portion 22 of partition plate 20 across first sealing member 141 and second sealing member 142.

Two or more projecting portions 152 are inserted into two or more holes 221 of projecting portion 22. The upper ends of projecting portions 152 are swaged so that ring-shaped portion 151 is pressed against the lower surface of projecting portion 22. Specifically, the upper ends of projecting portions 152 are deformed into a flat shape to fix blocking member 150 to partition plate 20 so that ring-shaped portion 151 is pressed against the lower surface of projecting portion 22. When blocking member 150 is made of an aluminum material, blocking member 150 can be easily swaged on partition plate 20.

In the state where first sealing member 141 and second sealing member 142 are attached to partition plate 20, an inner circumferential part of first sealing member 141 protrudes from ring-shaped portion 151 toward the center of partition plate 20, and an outer circumference part of second sealing member 142 protrudes from ring-shaped portion 151 toward the outer periphery of partition plate 20.

When partition plate 20 with first sealing member 141 and second sealing member 142 attached thereto is fitted inside hermetic container 10, the inner circumferential part of first sealing member 141 is pressed against the outer circumferential surface of upper boss portion 39 of fixed scroll 30, and the outer circumference part of second sealing member 142 is pressed against the inner circumferential surface of ring-shaped protrusion 310 of fixed scroll 30.

Intermediate-pressure space 30M communicates through intermediate-pressure port 37 with a region of compression chamber 50 in which an intermediate-pressure refrigerant in the middle of compression is present. Therefore, the pressure in intermediate-pressure space 30M is lower than the pressure in discharge space 30H and higher than the pressure in low-pressure space 12.

When, aside from discharge space 30H, intermediate-pressure space 30M is formed between partition plate 20 and fixed scroll 30 as described above, adjusting the pressing force of fixed scroll 30 against orbiting scroll 40 becomes easy.

Furthermore, since first sealing member 141 and second sealing member 142 form intermediate-pressure space 30M, it is possible to reduce the leakage of the refrigerant from discharge space 30H to intermediate-pressure space 30M and reduce the leakage of the refrigerant from intermediate-pressure space 30M to low-pressure space 12, for example.

Figure 10:
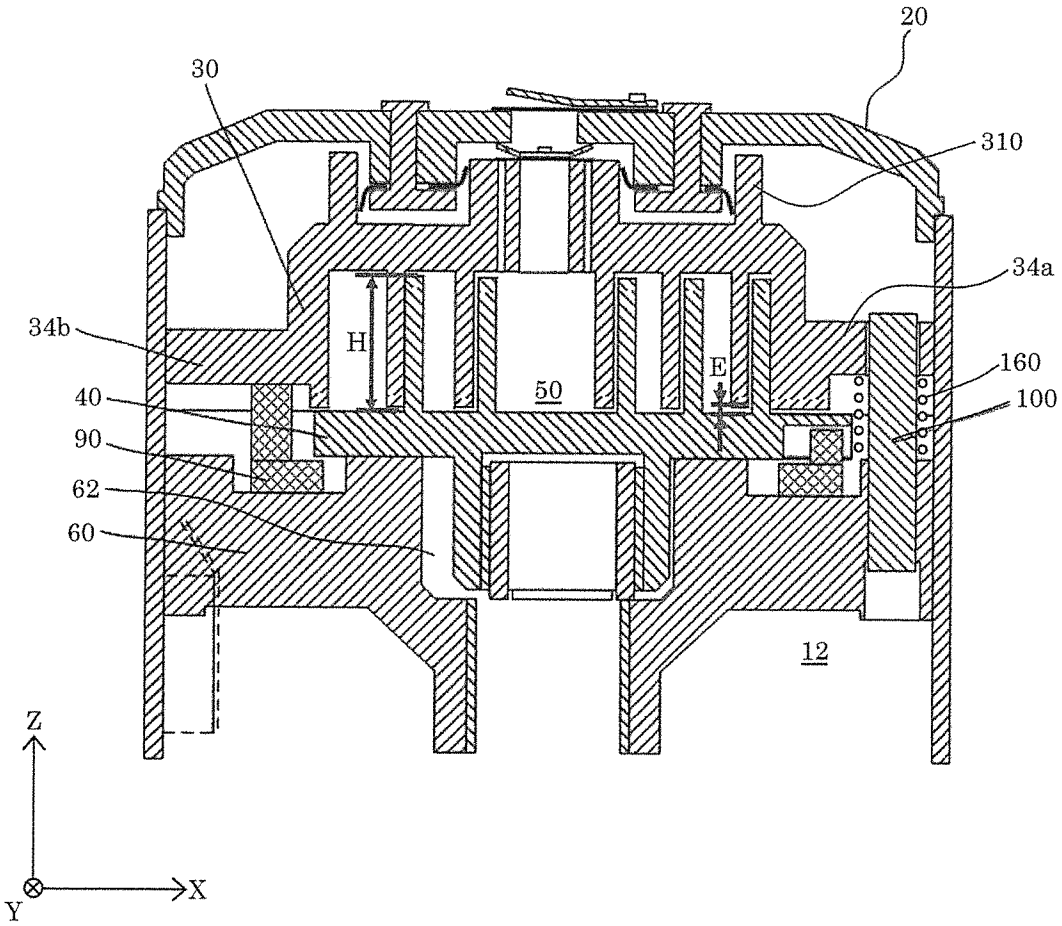
FIG. 10 is a cross-sectional view of a relevant portion of the scroll compressor according to the embodiment.

FIG. 10 is a cross-sectional view of a relevant portion of the scroll compressor according to the present embodiment. As illustrated in FIG. 10, elastic body 160 is provided between the lower surface of first flange 34*a* of fixed scroll 30 and the upper surface of main bearing 60. Elastic body 160 biases fixed scroll 30 away from orbiting scroll 40 (upward in FIG. 10).

Elastic body 160 is provided so as to cover columnar member 100. Elastic body 160 is a coil spring. Columnar member 100 is provided inside the coil of the coil spring.

Ratio E/H when compressor 1 is not in operation is set to 0.03 where E is a gap between an end of fixed scroll lap 32 of fixed scroll 30 and the upper surface of orbiting scroll end plate 41 of orbiting scroll 40 and H is a height of fixed scroll lap 32 of fixed scroll 30.

When compressor 1 is not in operation, at least a part of fixed scroll 30, for example, an end of ring-shaped protrusion 310, is in contact with the lower surface of partition plate 20 by elastic body 160.

According to the present embodiment, when compressor 1 is not in operation, gaps are formed between an end of fixed scroll lap 32 and orbiting scroll end plate 41 and between an end of orbiting scroll lap 42 and fixed scroll end plate 31 due to reaction force of elastic body 160.

Therefore, immediately after the start-up of compressor 1, complete compression is not performed in compression chamber 50, meaning that the compression load can be reduced. Thus, it is possible to improve the startability of compressor 1. Specifically, even when a single-phase motor with small starting torque is used as electric motor 801, it is possible to easily start compressor 1.

The pressure of the refrigerant that is discharged from compression chamber 50 to discharge space 30H and high-pressure space 11 gradually increases after the start-up of compressor 1. When the pressing force of fixed scroll 30 against orbiting scroll 40 exceeds the reaction force of elastic body 160, the gap between the end of fixed scroll lap 32 and orbiting scroll end plate 41 and the gap between the end of orbiting scroll lap 42 and fixed scroll end plate 31 disappear.

Consequently, when a predetermined time elapses after the start-up of compressor 1, complete compression is performed in compression chamber 50. Thus, the efficiency of compressor 1 is not reduced even when elastic body 160 is provided.

If elastic body 160 is provided between fixed scroll 30 and orbiting scroll 40, elastic body 160 also orbits, and therefore elastic body 160 is worn, leading to a reduction in reliability. Furthermore, the sliding loss between elastic body 160 and fixed scroll 30 or orbiting scroll 40 increases, reducing the efficiency of compressor 1. Therefore, elastic body 160 is desirably provided between fixed scroll 30 and main bearing 60 to avoid orbiting.

Furthermore, elastic body 160 can be provided to cover columnar member 100 to reduce the space for installation and thus downsize compression mechanism 170. In this case, there is no need to provide a recess or the like for positioning elastic body 160 on fixed scroll 30, main bearing 60, or the like, meaning that it is possible to reduce the number of processing steps. In addition, columnar member 100 plays a guiding role to deal with the expansion and contraction of elastic body 160, and thus the assembly is facilitated.

Furthermore, two or more elastic bodies 160 can be provided to prevent uneven separation of fixed scroll 30 from orbiting scroll 40 while compressor 1 is not in operation. With this, it is possible to reliably and stably provide a gap between the end of fixed scroll lap 32 and orbiting scroll end plate 41 and a gap between orbiting scroll lap 42 and fixed scroll end plate 31. Thus, it is possible to further improve the startability of compressor 1.

Two or more elastic bodies 160 are arranged circumferentially at predetermined intervals. It is desirable that two or more elastic bodies 160 be arranged circumferentially at equal intervals. In this case, it is possible to form a gap between the end of fixed scroll lap 32 and orbiting scroll end plate 41 and a gap between the end of orbiting scroll lap 42 and fixed scroll end plate 31 over the entire circumference of fixe scroll 30. Thus, it is possible to improve the startability of compressor 1.

When two or more elastic bodies 160 are arranged circumferentially at predetermined intervals, the reaction force of elastic bodies 160 is distributed, and thus, axial force is easily balanced. Accordingly, it is also possible to reduce the occurrence of an upsetting phenomenon due to elastic body 160, which is a phenomenon in which fixed scroll 30 is inclined with respect to orbiting scroll 40, during operation of compressor 1.

As elastic body 160, a leaf spring may be used, but a coil spring is desirable. Generally, the spring constant of a coil spring is lower than that of a leaf spring or the like. Therefore, even when the coil spring installed as elastic body 160 is varied in length due to variations in the assembly size of compression mechanism 170, it is possible to reduce variations in the reaction force of elastic body 160. Thus, the startability can be stably improved.

Alternatively, a metal spring, which has better durability than a resin-containing rubber component or the like, can be used as elastic body 160 to improve the reliability.

When compressor 1 is not in operation, at least a part of fixed scroll 30 is in contact with the lower surface of partition plate 20 by elastic body 160.

Thus, it is possible to regulate, as an assembly size, gap E between the end of fixed scroll lap 32 and the upper surface of orbiting scroll end plate 141. This makes it possible to reduce variations in the gap between the end of fixed scroll lap 32 and orbiting scroll end plate 41 and the gap between orbiting scroll lap 42 and fixed scroll end plate 31.

Figure 11:
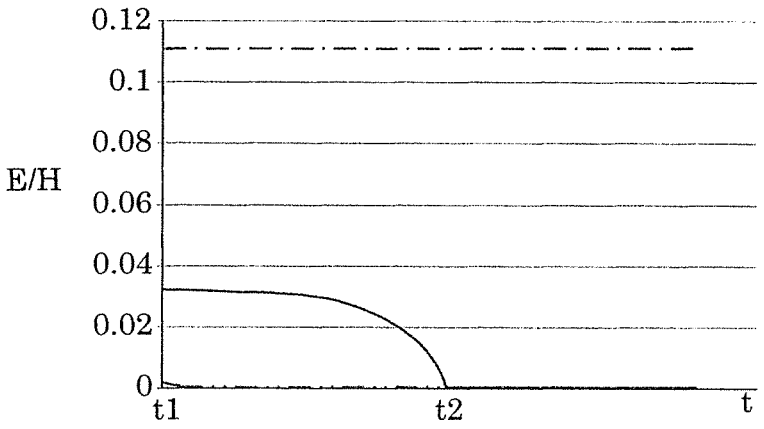
FIG. 11 shows the change over time of the ratio of the gap between an end of a fixed scroll lap and an orbiting scroll end plate to the height of the fixed scroll lap of the scroll compressor according to the embodiment.

FIG. 11 shows the change over time of ratio E/H where E is a gap between the end of the fixed scroll lap and the orbiting scroll end plate and H is the height of the fixed scroll lap of the scroll compressor according to the present embodiment. In FIG. 11, the horizontal axis represents elapsed time t from the start-up of compressor 1, and the vertical axis represents ratio E/H.

In FIG. 11, the solid line represents the result of compressor 1 in the present embodiment where ratio E/H is 0.03 when compressor 1 is not in operation, the alternate long and short dash line represents the comparative example where ratio E/H is 0.11 when compressor 1 is not in operation, and the alternate long and two short dashes line represents the comparative example where ratio E/H is 0.002 when compressor 1 is not in operation.

As illustrated in FIG. 11, in the case where ratio E/H is 0.03 when compressor 1 is not in operation, the gap formed between the end of fixed scroll lap 32 and orbiting scroll end plate 41 and the gap formed between the end of orbiting scroll lap 42 and fixed scroll end plate 31 are moderate. Thus, complete compression is not performed in compression chamber 50 immediately after the start-up of compressor 1. As the pressure of the refrigerant that is discharged from compression chamber 50 to high-pressure space 11 increases after the start-up of compressor 1, the gap between the end of fixed scroll lap 32 and orbiting scroll end plate 41 and the gap between the end of orbiting scroll lap 42 and fixed scroll end plate 31 are gradually reduced.

Consequently, the pressure in compression chamber 50 further increases and after the pressing force of fixed scroll 30 against orbiting scroll 40 exceeds the reaction force of elastic body 160 (after the lapse of predetermined time t2 from the start-up of compressor 1), the gap between the end of fixed scroll lap 32 and orbiting scroll end plate 41 and the gap between the end of orbiting scroll lap 42 and fixed scroll end plate 31 disappear, and complete compression is performed in compression chamber 50.

Therefore, until predetermined time t2 elapses after the start-up of compressor 1, compression chamber 50 has low sealing properties, and the compression load is low, meaning that it is possible to reduce the starting torque of electric motor 80. On the other hand, after the lapse of predetermined time t2, compression chamber 50 has increased sealing properties, meaning that efficient compression is possible.

In the case where ratio E/H is 0.1 or more, more specifically, in the case where ratio E/H is 0.11, even after predetermined time t2 elapses after the start-up of compressor 1, the gap between the end of fixed scroll lap 32 and orbiting scroll end plate 41 and the gap between the end of orbiting scroll lap 42 and fixed scroll end plate 31 are not reduced. Consequently, compression chamber 50 has low sealing properties, meaning that efficient compression is not possible.

This phenomenon is considered to be due to the following reason. In the case where ratio E/H is too large when compressor 1 is not in operation, the gap between the end of fixed scroll lap 32 and orbiting scroll end plate 41 and the gap between the end of orbiting scroll lap 42 and fixed scroll end plate 31 are not reduced enough to increase the sealing properties of compression chamber 50, resulting in the pressure in compression chamber 50 failing to increase with time. Consequently, even after sufficient time elapses after the start-up of compressor 1, the pressing force of fixed scroll 30 against orbiting scroll 40 does not exceed the reaction force of elastic body 160.

In the case where ratio E/H is 0.005 or less, more specifically, in the case where ratio E/H is 0.002, the gap between the end of fixed scroll lap 32 and orbiting scroll end plate 41 and the gap between the end of orbiting scroll lap 42 and fixed scroll end plate 31 are present for a short period from the start-up of compressor 1 to predetermined time t1. Consequently, immediately after the start-up, complete compression starts, and a large compression load is applied to compressor 1, meaning that it is not possible to start compressor 1 with a single-phase motor with small starting torque.

This phenomenon is considered to be due to the following reason. In the case where ratio E/H is too small when compressor 1 is not in operation, the gap between the end of fixed scroll lap 32 and orbiting scroll end plate 41 and the gap between the end of orbiting scroll lap 42 and fixed scroll end plate 31 are reduced immediately after the start-up of compressor 1. Consequently, immediately after the start-up of compressor 1, the pressing force of fixed scroll 30 against orbiting scroll 40 exceeds the reaction force of elastic body 160.

The compressor according to the present embodiment is configured so that fixed scroll 30 is pressed against orbiting scroll 40 due to the back pressure, that is, the pressure in high-pressure space 11, to increase the sealing properties of compression chamber 50. The same or similar effect of improving the startability can be obtained by a configuration in which orbiting scroll 40 is pressed against fixed scroll 30. However, with the configuration in which fixed scroll 30 is pressed against orbiting scroll 40, it is possible to set just the right level of pressing force in a wide operation range, meaning that it is possible to improve the startability and moreover to improve the efficiency of compressor 1.

Note that in the present embodiment, ratio E/H is the ratio of gap E between the end of fixed scroll lap 32 of fixed scroll 30 and the upper surface of orbiting scroll end plate 41 of orbiting scroll 40 to height H of fixed scroll lap 32 of fixed scroll 30, but may be the ratio of the gap between the end of orbiting scroll lap 42 of orbiting scroll 40 and the lower surface of fixed scroll end plate 31 of fixed scroll 30 to the height of orbiting scroll lap 42 of orbiting scroll 40.

Furthermore, the same or similar effects can be obtained by compressor 1 according to the variations described below.

Variation 1

Figure 12:
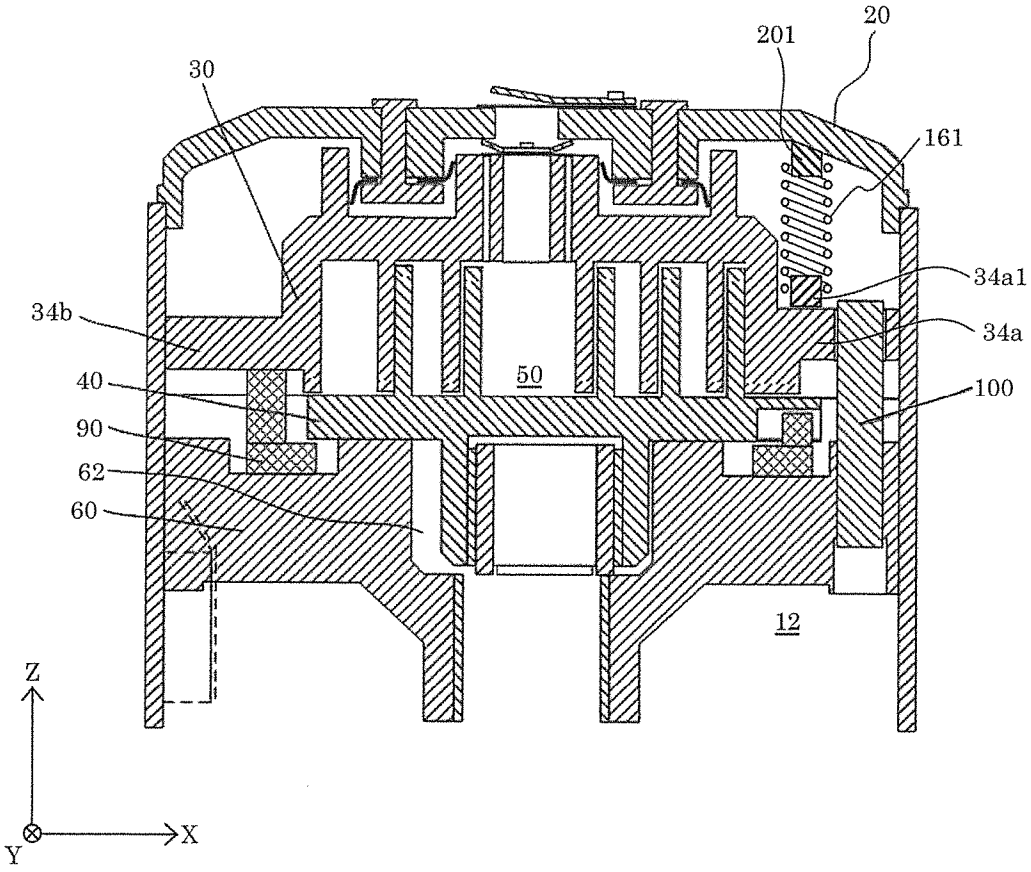
FIG. 12 is a cross-sectional view of a relevant portion of a scroll compressor according to Variation 1.

FIG. 12 is a cross-sectional view of a relevant portion of a scroll compressor according to Variation 1. The compressor according to Variation 1 includes elastic body 161 between partition plate 20 and fixed scroll 30 instead of elastic body 160. Elastic body 161 biases fixed scroll 30 away from orbiting scroll 40 (upward in FIG. 12).

More specifically, circular columnar protrusion **34*a*1 extending upward is provided on the upper surface of first flange 34*a* of fixed scroll 30. Circular columnar protrusion 201 extending downward is provided on the lower surface of partition plate 20, at a position opposite protrusion 34*a*1. Elastic body 161 is a coil spring and has its upper end inserted into protrusion 201 and its lower end inserted into protrusion 34*a*1**.

Variation 2

Figure 13:
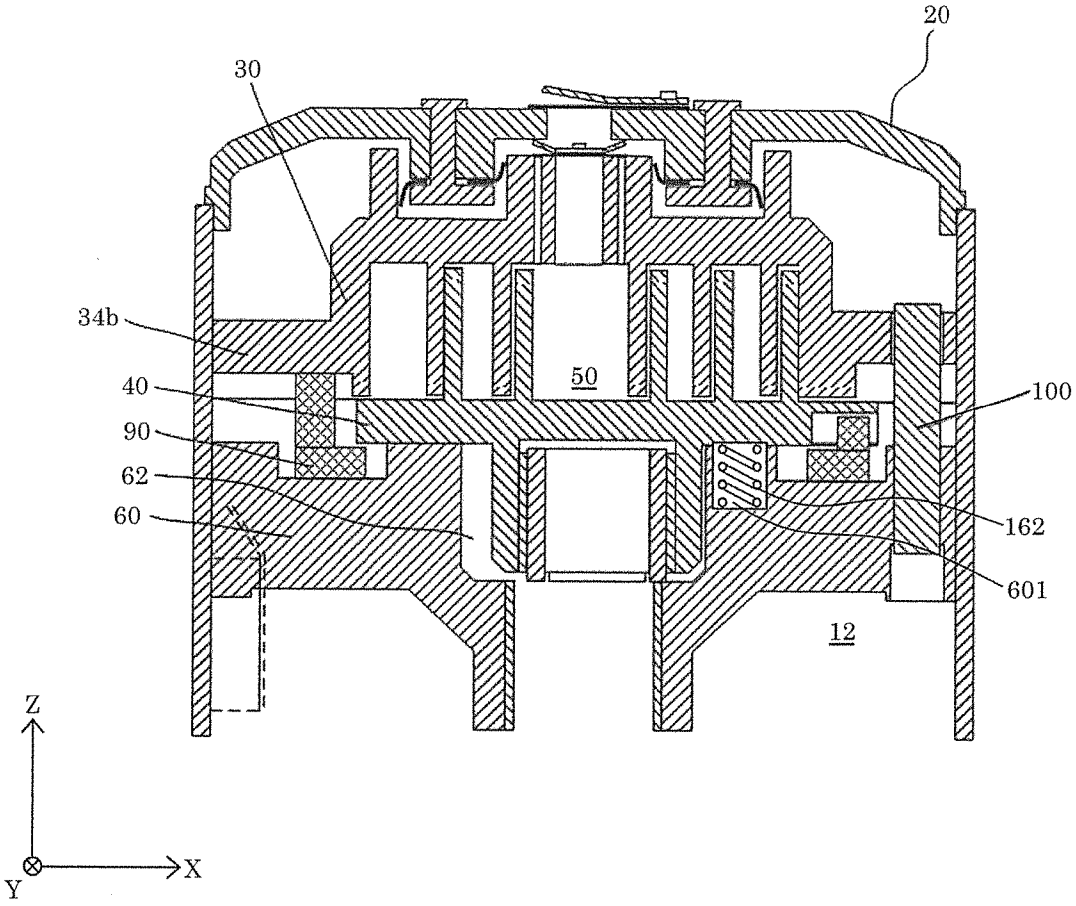
FIG. 13 is a cross-sectional view of a relevant portion of a scroll compressor according to Variation 2.
Figure 14:
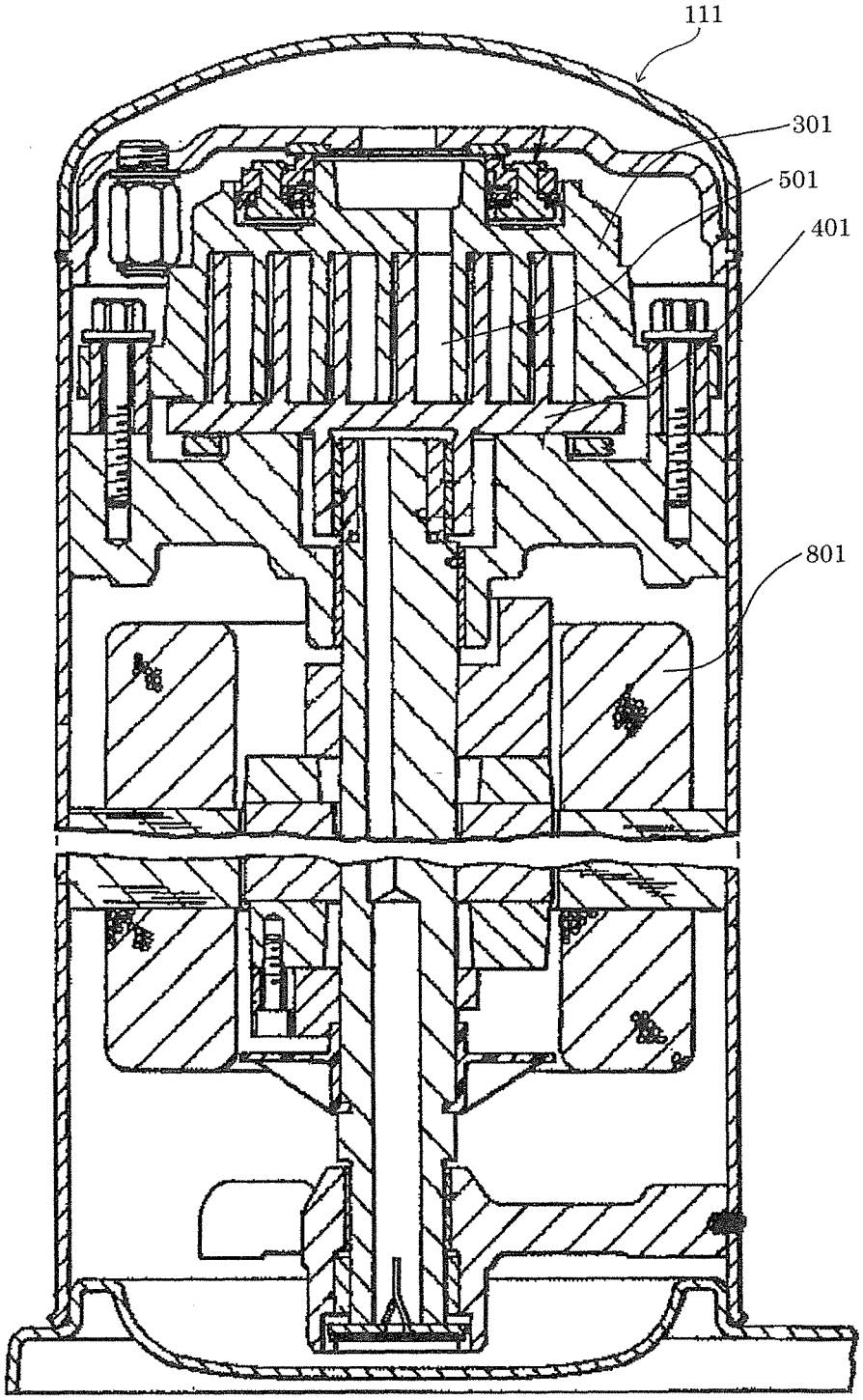
FIG. 14 is a vertical cross-sectional view of a conventional scroll compressor.

FIG. 13 is a cross-sectional view of a relevant portion of a scroll compressor according to Variation 2. The compressor according to Variation 2 includes elastic body 162 between main bearing 60 and orbiting scroll 40 instead of elastic body 160. Elastic body 162 biases orbiting scroll 40 away from fixed scroll 30 (downward).

More specifically, circular columnar recess 601 depressed downward is provided on the upper surface of main bearing 60. Elastic body 161 is a coil spring and is inserted into recess 601. Orbiting scroll 40 is supported by elastic body 161 so as to be axially (vertically) movable. The space on the lower surface side of orbiting scroll 40 communicates with discharge space 30H or intermediate-pressure space 30H. Therefore, orbiting scroll 40 is pressed against fixed scroll 30 during operation of compressor 1. Thus, the startability can be improved, and the gap between fixed scroll 30 and orbiting scroll 40 can disappear, meaning that it is possible to perform highly efficient operations.

INDUSTRIAL APPLICABILITY

The present invention is useful as a compressor of a refrigeration cycle device that is usable in electrical products such as a water heater, a hot-water heating system, and an air conditioner.

The invention claimed is:

1. A scroll compressor, comprising:

a partition plate that divides an inside of a hermetic container into a high-pressure space and a low-pressure space;

a non-orbiting scroll provided in the low-pressure space and positioned adjacent to the partition plate;

an orbiting scroll that engages the non-orbiting scroll and defines a compression chamber that is formed between the orbiting scroll and the non-orbiting scroll;

a rotating shaft that causes the orbiting scroll to orbit;

a main bearing that supports the orbiting scroll;

a columnar member that is inserted to make a receiver of the non-orbiting scroll movable and is supported by the main bearing; and an elastic body that is provided between the main bearing and the non-orbiting scroll and biases the non-orbiting scroll away from the orbiting scroll, wherein the non-orbiting scroll biased by the elastic body is movable between the partition plate and the main bearing in an axial direction of the rotating shaft, the non-orbiting scroll includes a first end plate and a first spiral body that stands on the first end plate, the orbiting scroll includes a second end plate and a second spiral body that stands on the second end plate and engages the first spiral body, and a ratio of a gap between an end of the first spiral body and the second end plate to a height of the second spiral body is at least 0.005 and less than 0.1 when the scroll compressor is not in operation.

2. The scroll compressor according to claim 1, wherein the non-orbiting scroll and the partition plate are in contact with each other when the scroll compressor is not in operation.

3. The scroll compressor according to claim 1, wherein the non-orbiting scroll is pressed against the orbiting scroll by pressure in the high-pressure space when the scroll compressor is in operation.

4. The scroll compressor according to claim 1, wherein the elastic body covers the columnar member.

5. The scroll compressor according to claim 1, wherein the elastic body comprises a plurality of elastic bodies.

6. The scroll compressor according to claim 5, wherein the plurality of elastic bodies are arranged at predetermined intervals in a circumferential direction of the rotating shaft.

7. The scroll compressor according to claim 1, wherein the elastic body is a coil spring.

8. The scroll compressor according to claim 1, wherein the main bearing includes a recess, and the elastic body is inserted into the recess.

* * * * *